United States Patent [19]

Aylesworth

[11] 4,267,715

[45] May 19, 1981

[54] SKI EQUIPMENT LOCK

[76] Inventor: Edward C. Aylesworth, 33511 Pacific Hwy. S., Federal Way, Wash. 98003

[21] Appl. No.: 55,180

[22] Filed: Jul. 6, 1979

[51] Int. Cl.[3] ..... E05B 73/00; E05B 37/02

[52] U.S. Cl. ..... 70/58; 70/19; 70/312

[58] Field of Search ..... 70/58, 19, 57, 304, 70/312; 211/605 K; 280/11.37 R, 11.37 B, 11.37 D, 11.37 H, 11.37 C, 11.37 K, 11.37 A

[56] References Cited

U.S. PATENT DOCUMENTS

| | | |
|---|---|---|
| 563,414 | 7/1896 | Richardson . |
| 1,724,835 | 8/1929 | Goodridge . |
| 2,186,456 | 1/1940 | Gordon . |
| 2,457,195 | 12/1948 | Bagnall . |
| 2,488,984 | 11/1949 | Pennington . |
| 2,508,302 | 5/1950 | Stue . |
| 3,297,333 | 1/1967 | Schwedt . |
| 3,335,585 | 8/1967 | Stretton . |
| 3,354,675 | 11/1967 | Quigg . |
| 3,899,904 | 8/1975 | Brimhall . |

FOREIGN PATENT DOCUMENTS

| | | | |
|---|---|---|---|
| 234013 | 6/1964 | Austria | 70/58 |
| 243551 | 7/1946 | Switzerland . | |

*Primary Examiner*—Robert L. Wolfe
*Attorney, Agent, or Firm*—Delbert J. Barnard

[57] ABSTRACT

A ski pole shaft is cut into two parts and a lock mechanism is interconnected between the two parts. The lock mechanism is telescopically moveable between an open position in which a pair of shackle jaws carried by the two parts are spaced axially apart, and a close position in which the two jaws are close together. One or both of the jaws may be formed to include a cordwise extending groove in the side thereof which faces the other jaw. A security line which is normally housed within the ski pole is pulled out from the ski pole, until an abutment at its inner end meets a stop that prevents further movement. The security line is wrapped about ski equipment and a fixed support and then a portion of its free end is set within the groove and the upper and lower sections of the pole are moved telescopically together. A combination lock carried by one part of the lock mechanism is operated to lock the two sections of the ski pole together. The jaws are together and the security line is prevented from being moved out from the groove or grooves. An enlarged head at the free end of the security line prevents such line from being pulled endwise out from the groove.

18 Claims, 4 Drawing Figures

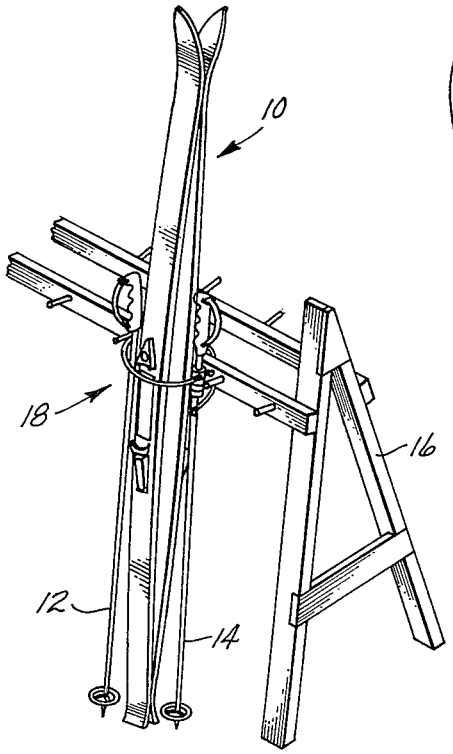
Fig. 1
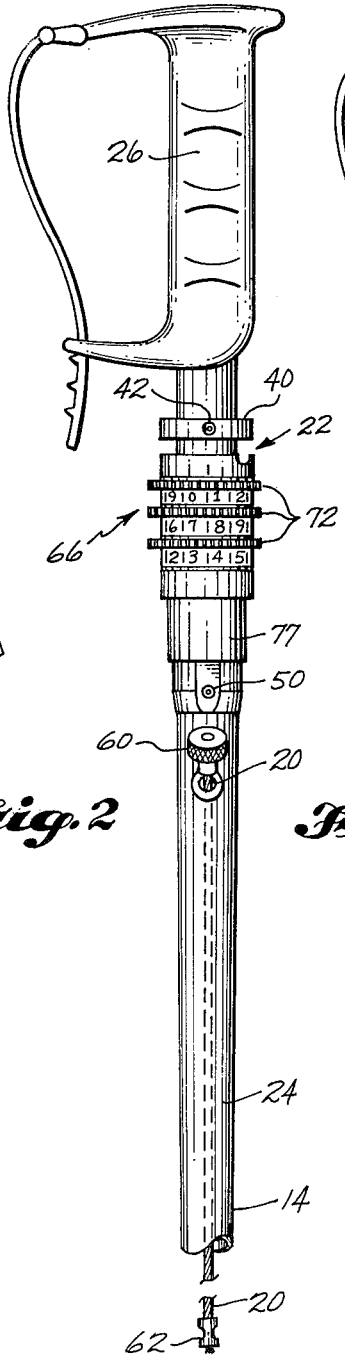
Fig. 2
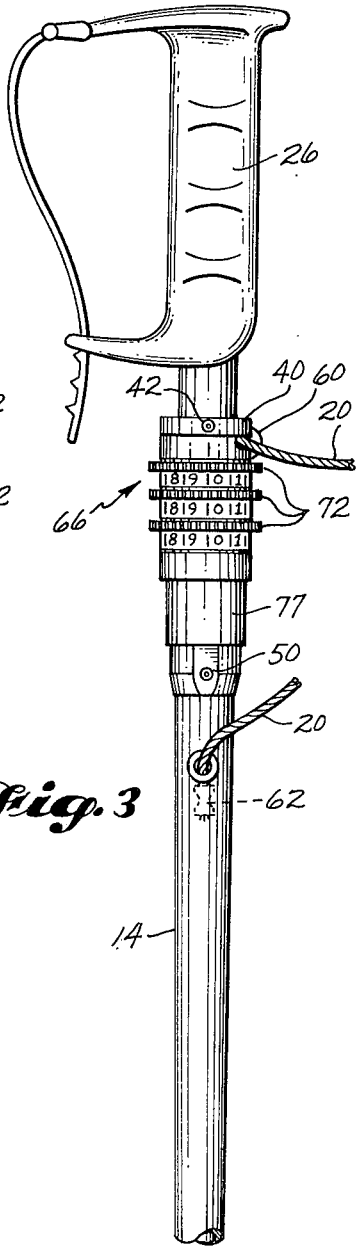
Fig. 3
Fig. 4
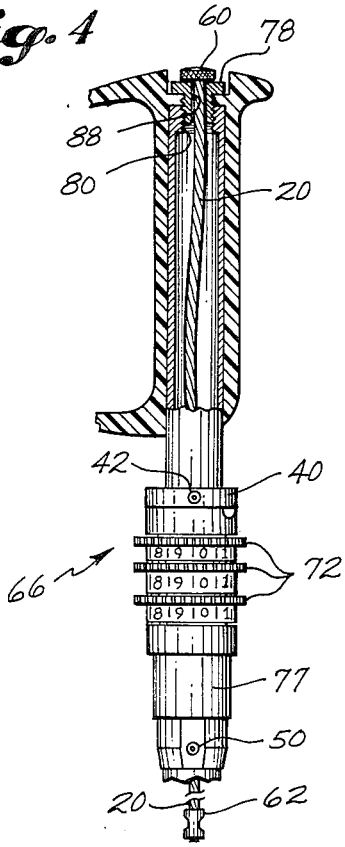

SKI EQUIPMENT LOCK

TECHNICAL FIELD

The present invention relates to a mechanism for locking ski poles and skis to a rack or other fixture, and more particularly to a lock mechanism which is incorporated into one of the ski poles.

BACKGROUND ART

The problem of ski equipment theft is thoroughly discussed in U.S. Pat. No. 3,354,675, granted Nov. 28, 1967 to Joanne M. Quiqq. Such patent also includes a discussion of some prior art.

U.S. Pat. No. 3,354,675, the various reference patents which are listed therein, and the following additional U.S. Patents disclose several types of security devices or locks which have been corporated into ski poles: U.S. Pat. No. 3,297,333, granted Jan. 10, 1967 to Robert C. Schwedt and Edward A. Atwill; U.S. Pat. No. 3,335,585, granted Aug. 15, 1967 to Bruce D. Stratton and U.S. Pat. No. 3,899,904, granted Aug. 19, 1975, to George H. Drimhall.

These patents and the following additional patents relating to lock mechanisms of the type which includes some sort of tie line should be carefully considered for the purpose of putting the present invention into proper perspective relative to the prior art: U.S. Pat. No. 563,414, granted July 7, 1996 to Charles N. Richardson; U.S. Pat. No. 1,724,835, granted Aug. 13, 1929 to Gilbert W. Goodridge; U.S. Pat. No. 2,186,456, granted Jan. 9, 1940, to Donald Gordon; U.S. Pat. No. 2,457,195, granted Dec. 28, 1948, to Joseph C. Bagnall, Jr.; U.S. Pat. No. 2,488,984, granted Nov. 22, 1949 to Fern R. Pennington; U.S. Pat. No. 2,508,302, granted May 16, 1950 to Tryggve B. Stue, and Swiss Pat. No. 243,551, patented July 31, 1946.

SUMMARY OF INVENTION

According to an aspect of the present invention, a security line shackle is provided which is integratable into a ski pole shaft below the handle grip. Such mechanism comprises first and second parts, each of which includes an end portion which is connectable to a section of a ski pole shaft and a jaw member which projects laterally outwardly beyond a side boundary of the ski pole shaft. The two parts are connected together by means which provides for a limited amount of telescopic movement of the two parts, between an open position in which the two jaw members are spaced apart axially a distance greater than the diameter of a security line and a closed position in which to two jaw members are positioned relatively close together. At least one of the jaw members includes a chordwise groove in the side thereof which faces towards the other jaw member. The groove is sized to receive a portion of a security line. One of the parts includes a lock means which is operable to lock the two parts together in the closed position.

According to another aspect of the invention, the security line is housed within the same ski pole which carries the shackle mechanism. The line is adapted to be stored when not in use within the ski pole shaft. It has an exposed end portion by which it can be grasped for the purpose pulling it out from its stored position. The second end of the security line is anchored within the ski poles shaft, so that the security line can not be completely separated from the ski pole.

An advantage of the ski equipment lock mechanism of the present invention is that it involves no separable part which can become lost. In operation, the lock mechanism is operated to permit a limited amount of telescopic movement of the upper and lower sections of the ski pole shaft, to open the two jaws of the shackle. The user then grasps the exposed end of the security line, pulls the line out from its stored position and wraps it around both the ski equipment (i.e. the skis and ski poles) and some fixed object. Then, the security line is placed into the groove formed in one of the jaws, the two parts of the shackle mechanism are telescopically moved together so that the second jaw member will trap the security line within the groove, and the lock mechanism is manipulated to lock the shackle in its closed position. The free end of the security line carries a large head which prevents the security line from being pulled endwise out from the groove.

Of course, there are other features of the illustrated embodiments which constitute important parts of the present invention. These features are set forth in detail below, as a part of the description of the illustrated embodiments. This summary, the claims, the drawing figures and the description of the illustrated embodiments all constitute parts of the description of the invention.

BRIEF DESCRIPTION OF THE DRAWING FIGURES

FIG. 1 is a pictorial view of a set of skis and ski poles locked to a ski rack by means of a mechanism constructed according to the present invention;

FIG. 2 is an enlarged scale view of an upper portion of a ski pole in which an embodiment of mechanism according to the present invention has been incorporated, such view showing the shackle mechanism in an unlocked position and its security line in its stored position;

FIG. 3 is a view like FIG. 2, but showing the security line withdrawn, a portion thereof within the groove formed in one of the jaw members, and the shackle mechanism in a locked position;

FIG. 4 is a view similar to FIGS. 2 and 3, but of a modified form of the invention, with the upper hand grip portion of the ski pole shown in longitudinal section;

DESCRIPTION OF THE PREFERRED EMBODIMENT

Figure 5:
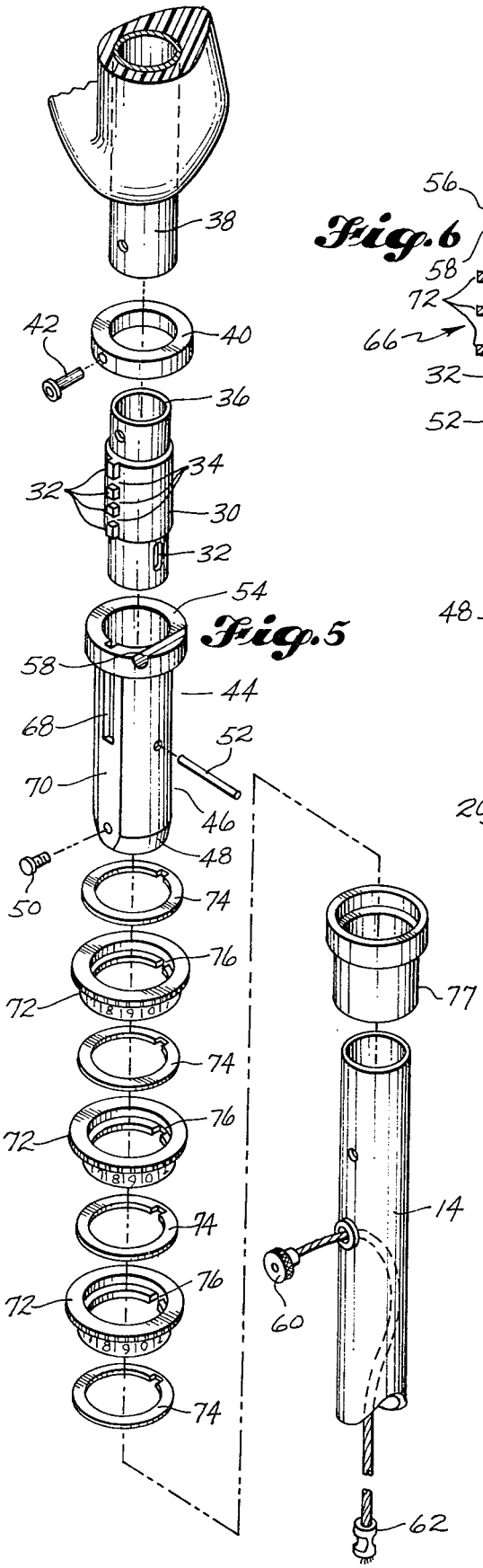
FIG. 5 is an exploded pictorial view of the first embodiment of the invention.

FIG. 1 shows a pair of skis 10 and a pair of ski poles 12, 14 secured to a fixed ski rack 16 by means of a lock mechanism 18 constructed according to the present invention.

According to an aspect of the invention, the lock mechanism 18 comprises two main components. These are a security line 20 and a security line shackle 22.

According to an aspect of the invention, the security line 20 is housed within a lower section 24 of one of the ski poles 14 and shackle mechanism 22 is incorporated bodily into the shaft portion of the same ski pole 14, closely below the handle or hand grip 26.

The shackle mechanism 22 comprises two main parts which are connected together for a limited amount of telescopic movement.

Figure 6:
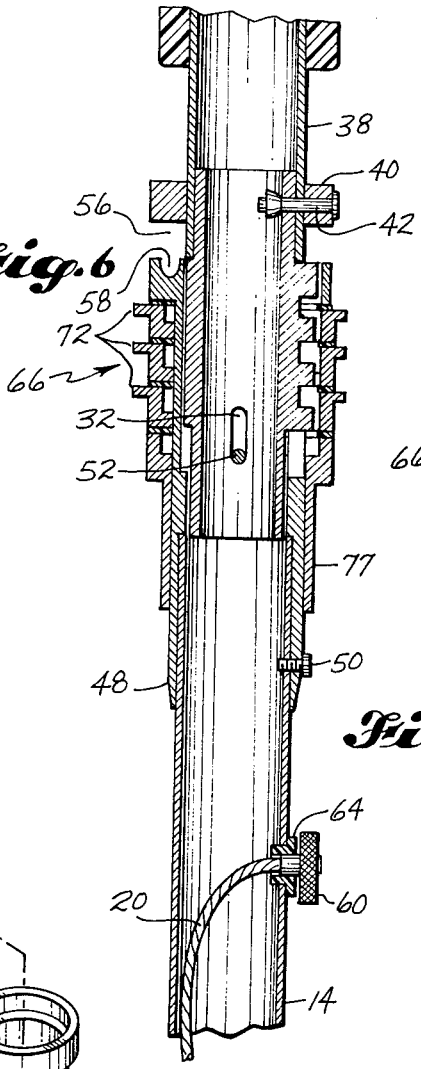
FIG. 6 is an enlarged scale longitudinal sectional view of such first embodiment, with the security line in its stored position and the shackle mechanism shown in its open or unlocked condition.
Figure 7:
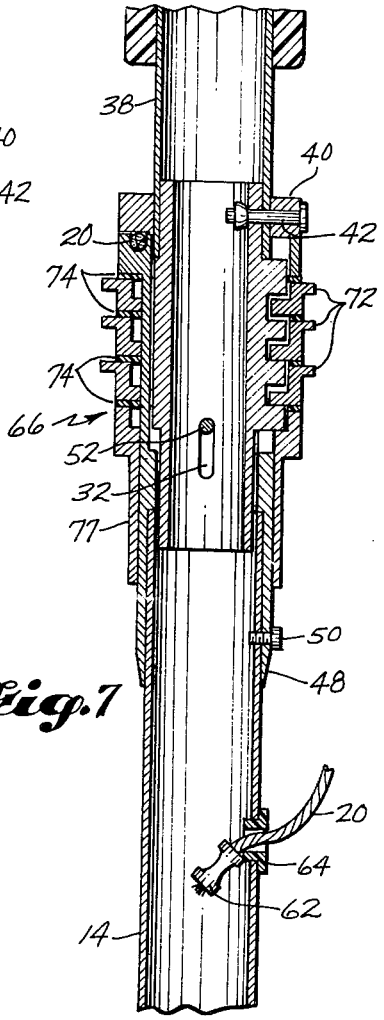
FIG. 7 is a view like FIG. 6, but showing the security line withdrawn, a portion thereof located within the groove formed in a jaw member, and the shackle mechanism in its locked condition.

Referring to FIGS. 5–7, the first part comprises an enongated tubular member 28 which may be surrounded by a sleeve 30 which carries a plurality of lock teeth 32 which are separated by a plurality of spaces 34. A lower portion of member 28 may be provided with an axially elongated slot 32.

The upper end portion 36 of member 28 serves to connect member 28 to an upper section 39 of the ski pole shaft. As best shown by FIGS. 6 and 7, end portion 36 is snugly received within the lower end portion of shaft section 38. A jaw member 40, shown in ring form, constitutes an important component of the first part of shackle mechanism 22. It is sized to snugly fit about the upper shaft section 28. A suitable pin type fastener 42 may extend through ring 40, shaft section 38, and the upper end portion 36 of tubular member 28. As shown, pin member 42 may be a "pop rivet".

The second part 44 of the shackle mechanism 22 also comprises an elongated tubular member 46. It has a lower end mounting portion 48 into which the upper end portion of the lower ski pole shaft section 24 is snugly received. Tubular member 46 may be secured to shaft section 24 by means of a set screw 50, or the like.

As clearly shown by FIGS. 5–7, member 46 carries a cross pin 52 which extends through the aforementioned elongated shaft 32 formed in member 28. Slot 32 and cross pin 52 together serve to define limites of telescopic movements of shackle section 28 relative to shackle section 44. FIG. 6 shows the extended limit of telescopic movement and FIG. 7 shows the retracted limit of telescopic movement.

Shackle member 44 carries a second jaw 54 at its upper end, i.e. the end thereof opposite the mounting end 48. Jaw 54 may also be in the form of a ring, as shown. Of course, in other installations the form of jaw members 40, 54 may differ from what is illustrated. The important characteristic is that the jaw members 40, 54 comprise co-operative portions which extend laterally outwardly from the normal side boundaries of the ski pole, so as to form an open "jaw" space 56 (FIG. 6) when the two parts of the shackle mechanism are extended.

One of the jaw members 40, 54 (member 54 in the illustrated embodiment) comprises a chordwise extending slot or groove 58 which is formed in the side part of the jaw member 54 which faces towards the other jaw member 40. This groove of slot 58 is sized to receive at least a substantial portion of the security line 20. In some installations it may be desirable to form complementary grooves in the two jaw members, rather than a single groove in one of the jaw members.

Referring now to FIG. 6, when the two parts of the shackle mechanism 22 are telescopically apart (i.e. the extended position), a space 56 exists axially between the two jaw members 40, 54. The axial dimension of the space 56 is larger than the diameter of the security line 20. When the two parts of the shackle mechanism 22 are relatively together (i.e. the retracted position) jaw members 40, 54 are contiguous and no space 56 exists out through which the security line 20, may be moved from its position within the groove 58.

As shown by FIGS. 2–6, the outer or free end of security line 20 is fitted with an enlarged head 60. Head 60 prevents the security line 20 from droping all of the way into the lower section 24 of ski pole shaft 14, and also prevents the security line 20 from being moveable endwise out from its position within the groove 58. The opposite end of security line 20 is provided with an abutment 62 which prevents complete removal of the security line 20 from the lower section 24 ski pole 14. FIG. 7 shows abutment 62 in a position up against a fitting 64 provided in a side wall portion of the ski pole shaft section 24. A similar type stop is provided in the embodiment of FIG. 4. Specifically, the embodiment of FIG. 4 may include a stop of the type that is disclosed by the aforementioned U.S. Pat. No. 3,354,675.

The shackle mechanism 22 of the present invention may be provided with a combination lock 66 which is basically of the same type as is shown in the U.S. Pat. No. 3,354,675.

Combination lock 66 includes the above described sleeve 30 and the axial row of lock teeth 32, separated by the gaps or spaces 34. Tubular member 44 may be formed to include a slot 68 into which the row of lock teeth 32 may fit. Unless restrained, in a manner to shortly described, the lock teeth 32 may move axially within the slot 68 as the two members 28, 44 are moved telescopically together and apart.

As clearly shown by FIGS. 6 and 7, the lock teeth 32 are sized to project laterally outwardly from a side face portion 70 of member 44. Face 70 is a flatened side portion formed on the member 44 which in other respects has a circular cross-sectional configuration.

A plurality of locking rings 72, separated from each other by a plurality of bearing rings 74, surround and are rotatable, about the main body portion of member 44 (FIGS. 6 and 7). Ring members 72 each include a notch or open area 41 which is sized to loosely receive the lock teeth 32. When the recess 76 are all moved in axial alignment with the lock teeth 32, the two parts of the shackle mechanism may moved telescopically together or apart. However, when a solid section of any one of the lock rings 72 is located within a space 34 between or below one of the lock teeth 32, it would block any telescopic movement of the two parts of the shackle mechanism resulting in the shackle mechanism being locked in its closed position.

As clearly disclosed by the aforementioned U.S. Pat. No. 3,456,675, each of the lock wheel 72 may be provided with a series of numbers spaced circumferentially about it, and a portion of the mechanism spaced endwise of the wheel 72 may be provided with a notch or other index. Thus, the lock rings 72 become a combination lock and all the user has to do is to dial to correct set of numbers in order to align the open areas 76 with the row of lock teeth 32, so that the upper and lower portions of the shackle mechanism can be telescopically moved apart.

In operation, the two ski poles and the skis are placed up against a fixed support, e.g. the stand 16 is shown by FIG. 1. The security line 20 is withdrawn from pole 14 and is wrapped about both the ski equipment 10, 12, 14 and a portion of the fixed support 16. The security line 20 is then set into the groove 56. The upper part of the ski pole 14 is telescopically moved into the lower part of the ski pole 14. Then, the lock rings 72 are spun for the purpose of moving the open areas 76 out from alignment from the lock teeth, and the solid portions of the lock rings into the spaces 34 (FIG. 7). The ski equipment is now securely locked to the object 16 and will remain locked until the user radials the correct combination, to permit telescopic movement of the two parts of the lock mechanism, permitting jaw 40 to be moved axially away from jaw 54.

The embodiment of FIG. 4 is operated in essentially the same way as the embodiment of FIGS. 1–3 and 5–7. The upper end of the ski pole shaft may be provided with a threaded fitting 78 which is adapted to mate with a complementary fitting 80 at the upper end of the ski pole shaft 14. The, the lock rings 72 are spun for the purpose of moveing the open areas 76 out from alignment form the lock teeth, and the solid portions of the lock rings into the spaces 34 (FIG. 7). The ski equipment is now securely locked to the boject 16 and will remain locked until the user redials the correct combination, to permit telescopic movement of the two parts of the lock mechanism, permiting jaw 40 to be moved axially away from jaw 54.

The embodiment of FIG. 4 is operated in essentially the same way as the embodiment of FIGS. 1–3 and 5–7. The upper end of the ski pole shaft may be provided with a threaded fitting 78 which is adapted to mate with a complementary fitting 80 at the upper end of the ski pole shaft 14. Fitting 78 includes an axial passage way 82 extending through it in which the security line 20 is received. The user need only grasp the head 60 at the end of security line 20 and pull on it to retract the security line 20 out from the interior of the ski pole. Line 20 may be withdrawn in this manner until the abutment 62 at its opposite end comes into a seated position against an internal stop.

INDUSTRIAL APPLICABILITY

The lock mechanism of the present invention is whon as being a part of a ski pole and as being used for securing ski equipment to some sort of fixed support, for the purpose of preventing theft of such ski equipment. However, it is to be understood that the lock mechanism may have generaly utility and may be incorporated into some other structure, particularly into some other shaft type structure having similarities to a ski pole shaft.

What is claimed is:

1. A security line shackle integratable into a ski pole shaft below the handle, comprising:

first and second parts, each including an end portion connectable to a section of a ski pole shaft, and each including a jaw member which projects laterally outwardly beyond a side boundry of the ski pole shaft;

means connecting said first and second parts together for limited telescopic movement, between an open position in which the two jaw members of the two parts are spaced apart axially a distance greater than the diameter of a security line and a closed position in which the two jaw members are positioned relatively close together;

at least one of the jaw members including a chordwise groove in the side thereof which faces towards the other jaw member, said groove being sized to receive a portion of a security line; and lock means carried by one of said parts operable to lock the two parts together in said closed position.

2. A security line shackle according to claim 1, wherein said first part comprises a first elongated tubular member, said second part comprises a second elongated tubular member in telescopic engagement with the first tubular member, wherein one of said tubular members if formed to include an axially elongated slot and the other tubular member carries a radial pin which is received within said slot, said slot and pin serving to define limits of relative telescopic movement between the two tubular members.

3. A security line shackle according to claim 1, wherein said first part comprises an elongated tubular member having a mounting end portion which is sized to be received within a first tubular ski pole shaft section, and wherein the jaw member associated with the first part is a ring member sized to surround such ski pole shaft section.

4. A security line shackle according to claim 1, wherein the second part includes an elongated tubular member having a mounting end portion in which an end portion of a second section of the ski pole shaft is received.

5. A security line shackle according to claim 1, wherein said first part comprises an elongated first tubular member which carries a plurality of axially aligned lock teeth having spaces between them, said second part comprises an elongated second tubular member in which the first tubular member is telescopically received, said second tubular member including an axial slot in which said row of teeth are are received, and wherein a plurality of wheels are mounted onto said second tubular member for rotation thereabout, said wheels including radial flanges which are situated in spaces between said lock teeth, and said flanges including open areas sized to permit passage of the lock teeth therethrough upon alignment of said open areas and said lock teeth.

6. A security line shackle according to claim 5, wherein one of said tubular members is formed to include an axial elongated slot and the other tubular member carries a radial pin which is received within said slot, said slot and pin serving to define limits of relative telescopic movement between the two tubular members.

7. A security line shackle according to claim 5, wherein the first tubular member includes a mounting end portion which is sized to be snugly received within a first tubular ski pole shaft section, and wherein the jaw member associated with the first part is a ring member sized to snugly surround such ski pole shaft section.

8. A security line shackle according to claim 7, wherein the second part includes an elongated tubular member having a mounting end portion in which an end portion of a second section of the ski pole shaft is received.

9. A security line shackle according to claim 8, wherein the jaw member associated with the second part is a ring member located at the end of the second tubular member opposite the mounting end portion thereof.

10. Mechanism for locking ski equipment to a rack or other fixture, comprising:

a ski pole having an upper section including a hand grip, and a lower section;

a security line shackle interconnected between said ski pole sections, comprising:

first and second parts, below the handle each including an end portion connectable to a section of a ski pole shaft, and each including a jaw member which projects laterally outwardly beyond a side boundry of the ski pole shaft;

means connecting said first and second parts together for limited telescopic movement, between an open position in which two jaw members of the two parts are spaced apart axially a distance greater than the diameter of a security line and a closed position in which the two jaw members are positioned relatively close together;

at least one of the jaw members including a chordwise groove in a side thereof which faces towards the other jaw member, said groove being sized to receive a portion of a security line; and lock means carried by one of said parts operable to lock the two parts together in said closed position; and a security line moveable between a stored position within the ski pole and a used position in which an end thereof is anchored within the ski pole and the rest of it is outside of the ski pole.

11. Mechanism according to claim 10, wherein said first part comprises a first elongated tubular member, said second part comprises a second elongated tubular member in telescopic engagement with the first tubular member, wherein one of said tubular members is formed to include an axially elongated slot and the other tubular member carries a radial pin which is received within said slot, said slot and pin serving to define limits of relative telescopic movement between the two tubular members.

12. Mechanism according to claim 10, wherein said first part comprises an elongated tubular member having a mounting end portion which is sized to received within a first tubular ski pole shaft section, and wherein the jaw member associated with the first part is a ring member sized to surround such ski pole shaft section.

13. Mechanism according to claim 10, wherein the second part includes an elongated tubular member having a mounting end portion in which an end portion of a second section of the ski pole shaft is received.

14. Mechanism according to claim 10, wherein said first part comprises an elongated first tubular member which carries a plurality of axially aligned lock teeth having spaces between the, said second part comprises an elongated second tubular member in which the first tubular member is telescopically received, said second tubular member including an axial slot in which said row of teeth are received, and wherein a plurality of wheels are mounted onto said second tubular member for rotation thereabout, said wheels including radial flanges which are situated in the spaces between said lock teeth, and said flanges including open areas sized to permit passage of the lock teeth therethrough upon alignment of said lock teeth.

15. Mechanism according to claim 14, wherein one of said tubular members is formed to include an axial elongated slot and the other tubular member carries a radial pin which is received within said slot, said slot and pin serving to define limits of relative telescopic movement between the tubular members.

16. Mechanism according to claim 14, wherein the first tubular member includes a mounting end portion which is sized to be snugly received within a first tubular ski pole shaft section, and wherein the jaw member associated with the first part is a ring member sized to snugly surround such ski pole shaft section.

17. Mechanism according to claim 16, wherein the second part includes an elongated tubular member having a mounting end portion in which an end portion of a second section of the ski pole shaft is received.

18. Mechanism according to claim 17, wherein the jaw member associated with the second part is a ring member located at the end of the second tubular member opposite the mounting end portion thereof.

* * * * *